US007337845B1

(12) United States Patent
Mansuy

(10) Patent No.: US 7,337,845 B1
(45) Date of Patent: Mar. 4, 2008

(54) WELL MAINTENANCE EQUIPMENT AND PROCEDURE

(75) Inventor: Neil Mansuy, Kansas City, MO (US)

(73) Assignee: Subsurface Technologies, Inc., Rock Tavern, NY (US)

( * ) Notice: Subject to any disclaimer, the term of this patent is extended or adjusted under 35 U.S.C. 154(b) by 0 days.

(21) Appl. No.: 10/311,735

(22) PCT Filed: Jun. 20, 2000

(86) PCT No.: PCT/US00/17043

§ 371 (c)(1),
(2), (4) Date: Jul. 16, 2003

(87) PCT Pub. No.: WO01/98628

PCT Pub. Date: Dec. 27, 2001

(51) Int. Cl.
*E21B 37/06* (2006.01)

(52) U.S. Cl. ..... 166/312; 166/263

(58) Field of Classification Search ..... 166/260, 166/261, 303, 312, 264
See application file for complete search history.

(56) References Cited

U.S. PATENT DOCUMENTS 4,454,917 A * 6/1984 Poston ..... 166/303
4,880,057 A * 11/1989 Derowitsch ..... 166/267
5,168,930 A * 12/1992 Wiseman et al. ..... 166/307
5,190,108 A * 3/1993 Mansuy ..... 166/371
6,142,232 A * 11/2000 Troutt et al. ..... 166/312
6,250,388 B1 * 6/2001 Carmi et al. ..... 166/311

* cited by examiner

*Primary Examiner*—David Bagnell
*Assistant Examiner*—Giovanna M Collins
(74) *Attorney, Agent, or Firm*—Hunton & Williams LLP; Eugene C. Rzucidlo

(57) ABSTRACT

The present invention relates to a method of removing deposits from various types of wells (17) including environmental recovery, water supply, horizontal, barrier, injection, recharge, and/or disposal wells (17). The method includes equipping a well (17) with an automated energy delivering system that is attached to the well (17). The energy delivering system is used to clean the surface of the well (17) and aquifer by supplying various types of energy to the well (17) and aquifer via injection lines (5, 6, 8, 11 and 12) and an educator pipe (10). A pump (14) is used to pump the energy through flow valves (21 and 20) and injection lines (5, 6, 8, 11 and 12) and into the well (17). The energy that is supplied to the well (17) mobilizes any deposits in the well (17) and aquifer and cause them to flow into and up the wellbore thereby cleaning the well (17) and aquifer.

4 Claims, 4 Drawing Sheets

WELL MAINTENANCE EQUIPMENT AND PROCEDURE

FIELD OF THE INVENTION

Barrier wells are designed for injection of water or fluids for the purpose of creating a hydraulic barrier. These wells are often designed to prevent salt-water intrusion or create a hydraulic barrier, which prevents the migration of contaminants. Barrier wells are most often not equipped with pumping equipment and therefore cannot be backflushed periodically. Injection or disposal wells can be used for the purpose of wastewater disposal or injection of water into wells. Recharge Wells are wells that are dedicated injection wells for the purpose of recharging groundwater into subsurface environments. Without pumps in all of these wells it is also not possible to easily perform preventative chemical treatments or well rehabilitation chemical treatments. When these wells are operated for a period of time they are susceptible to the same deposition problems as seen on surfaces of many water environments. Depending upon the injection water and the aquifer water, the deposits that occur on surfaces in these environments can vary significantly. These deposits commonly consist of bacterial extra cellular polysaccharides (ECPS) and their associated minerals. The associated mineral deposits are most commonly various ratios of iron, manganese, calcium, magnesium, and silicates.

When barrier wells, injection wells, recharge wells, and/or disposal wells experience loss of specific injection or loss of injection capacity, it is common for them to require some type of rehabilitation treatments. The common rehabilitation treatments include application of various chemistries and other physical or mechanical procedures. The current limitation with these wells is the lack of pumping equipment necessary to occasionally backflush the well to remove the softer material. Periodically pumping an injection well is similar to flushing distribution mains, to remove the material that can be removed with high velocity water. Many of the deposits that exist are attached to surfaces more tenaciously than what water will have the potential to remove. Backflushing wells periodically that are equipped with pumps can be a relatively effective process for extending the time frame between more aggressive rehabilitation treatments.

Aquifer Storage and Recovery (ASR) wells are commonly used for groundwater recharge and water banking purposes. ASR wells are commonly installed to inject water into aquifers when there is significant capacity and low demand, and pump the same water out of the aquifer when there is significant demand and less water. ASR wells are often constructed as dual-purpose wells of alternating seasons or cycles of injection and extraction. These wells are often equipped with pumps and the injection is often done through the pump. The pump is used to pump water from the well often during the summer months. The ASR wells that are equipped with pumping equipment can be periodically backflushed during the injection season to remove some of the softer material. Pumping an ASR well periodically (perhaps weekly) during the injection season is similar to flushing distribution mains where the material that can be removed with high velocity conditions is flushed from the well.

A very frequent problem associated with operation of ASR wells is loss of specific injection or loss of specific capacity and water quality problems. When ASR wells are operated for a period of time they are susceptible to the same deposition problems as seen on surfaces of many water environments. The rate of deposition and biofouling is often enhanced over traditional water supply wells and varies significantly due to the creation of different environments for biological growth and mineral oxidation and deposition. Depending upon water quality, the deposits that occur on surfaces in these environments can vary significantly. These deposits commonly consist of bacterial extra cellular polysaccharides (ECPS) and their associated minerals. The associated mineral deposits are most commonly various ratios of iron, manganese, calcium, magnesium, and silicates combined with a variety of anions. Depending upon the nature of the deposit, some of these deposits can be more difficult to remove than other deposits.

Water supply production wells are commonly used for potable, agricultural and industrial purposes. These wells vary significantly in construction based upon geology, capacity, chemistry, history of construction, etc. Water supply wells are most often equipped with some type of pumping mechanism. A very frequent problem associated with operation of water supply wells is lost capacity and associated water quality problems. When water supply wells are operated for a period of time they are susceptible to the same deposition problems as seen on surfaces of many water environments. The rate of deposition and biofouling varies significantly due to the creation of different environments for biological growth and mineral oxidation and deposition. Depending upon the water quality, the deposits that occur on surfaces in these environments can vary significantly. These deposits commonly consist of bacterial extra cellular polysaccharides (ECPS) and their associated minerals. The associated mineral deposits are most commonly various ratios of iron, manganese, calcium, magnesium, and silicates combined with a variety of anions. Depending upon the nature of the deposit, some of these deposits can be more difficult to remove than others.

Many different technologies are used to rehabilitate water supply wells. When these wells experience loss of specific capacity or water quality problems, it is common for them to require some type of rehabilitation treatments. The common rehabilitation treatments include application of various chemistries and other physical or mechanical procedures. The current limitation with rehabilitation on some wells is the same limitations that are commonly experienced with removal of plugging material. Many of the deposits that exist in water environments are attached to surfaces and can be often difficult to remove. Preventative maintenance treatments on wells can be effective occasionally. These treatments are performed periodically with the pumps and can be an effective process for extending the time frame between more aggressive rehabilitation treatments. The limitations experienced with preventative maintenance treatments are the same limitations experienced on many wells with the difficulty in removing the deposited material from the surfaces. These difficulties include lack of vertical velocity inside the well itself and lack of velocity (energy) into the surrounding aquifer. Velocity of water is often not capable of removing the deposited material and needs the aid of additional chemical or mechanical energy to achieve the removal. Another rehabilitation process that can be very effective is the use of gaseous and liquid carbon dioxide (the Aqua Freed process). The advantage of the Aquafreed™ process includes the environmental safety of good energy applied to many different parts of the well and the aquifer.

Many different technologies are used to rehabilitate ASR wells. When these wells experience loss of specific injection or loss of specific capacity, it is common for them to require some type of rehabilitation treatments. The common rehabilitation treatments include application of various chemistries and other physical or mechanical procedures. The current limitations with rehabilitation on ASR wells are the same limitations that are commonly experienced with rehabilitation on production wells. Many of the deposits that exist are attached to surfaces more tenaciously than what water will have the potential to remove. Backflushing wells periodically that are equipped with pumps can be a relatively effective process for extending the time frame between more aggressive rehabilitation treatments. The limitations experienced with backflushing are the same limitations experienced on many wells with the difficulty in removing the deposited material from the surfaces. These difficulties include lack of vertical velocity inside the well itself and lack of velocity into the surrounding aquifer to achieve detachment of material. Velocity of water will not be capable of removing all the deposited material and needs the aid of chemical or mechanical energy to achieve that. The advantage of the Aqua Freed™ process includes the environmental safety of a higher level of energy applied to many different parts of the well and the aquifer. See U.S. Pat. Nos. 4,453,413 and 5,394,942. The disclosure of which are expressly incorporated by reference thereto.

Many of the deposits that exist in these wells are difficult to remove from surfaces in water environments. Current technology involves relatively expensive procedures with chemical application and the equipment associated with chemical application as well as physical and mechanical means. This equipment is mobilized to a site every time these wells experience loss of injection capacity. Mobilization and demobilization is one of the significant costs associated with the overall treatment costs.

Another limitation of current technology is the lack of energy necessary to get complete removal from the surfaces within these water environments. The energy used is commonly chemical and mechanical energy transferred to the surfaces with water as the carrier. Liquid carbon dioxide (the Aqua Freed™ process) is also a current technology that has the capability to achieve a higher level of energy into the surrounding formation. This higher level of energy has the capability to get detachment of material from the surfaces, where other methods may face limitations. Even though the Aqua Freed™ process has the capability to get more complete removal of material at the present time it is not appropriate for preventative maintenance treatments. At the present time in order to perform an Aqua Freed™ treatment it is necessary to pull the pump and install the injection and development equipment.

SUMMARY OF THE INVENTION

The present invention relates to the more effective maintenance of wells including ASR, environment of recovery, water supply, horizontal, barrier, injection, recharge, and/or disposal wells. The invention comprises equipping wells with necessary apparatus to effectively clean the surfaces of the wells and aquifers such without the need for installation of equipment and mobilization to site. The apparatus would involve installation of equipment to seal the well (i.e. packer) and the energy injection equipment at various locations in the well. This equipment would then be left in the well. When the preventative maintenance procedure is complete, the packer may be released. The well can be operated in a sealed or unsealed condition. The important placement of the injection and development equipment is essential in order to deliver the proper energy, mechanical, thermal, chemical and physical to the surfaces of the well and aquifer and to remove the material from the zones of the well that are often difficult to do. These difficult zones involve the bottom of the well, where it can be difficult to fluidize the sediments and deposits that have been detached from the surfaces. If the sediments are not fluidized they will remain in zones of the well where the velocities are inadequate to get the particles moving. In order to get a particle moving it does require enough energy to overcome the inertial and attractive forces that are keeping the particle in place. The use of the Aqua Freed™ process is one of the few procedures that has the energy capable of overcoming those attractive forces and moving the sediments to the area of the well or installed equipment where it can be removed from the subsurface. Once the injection lines are permanently installed it is also possible to apply various chemistries for dissolving deposits (both inorganic and organic) or disinfecting wells and aquifers. It is also possible to agitate the chemistries in place with the use of gases (i.e. carbon dioxide) which would allow more even application of chemistry in the well and allow better removal of deposits from surfaces.

Wells that are equipped with pumps would need to have packers installed around the column pipe. Wells that are not equipped with pumps would be either permanently equipped with packers or left in a sealed condition or the packer can be deflated during normal operation. The more important aspect to the permanent apparatus installed in the well includes the equipment to inject chemicals and/or liquid carbon dioxide and the equipment to air lift the material from the well. If airlifting material to surface is not practical, the suspended particulate material can be moved to the pump for removal from the well. This equipment can vary but would include some mechanism to deliver energy into the bottom of the well and into the surrounding formation and move particulate material upward in the well.

The present invention also includes the equipment necessary to adequately remove the sediments from the bottom part of a well and surrounding aquifer. This type of equipment could be either a pump (permanent or temporary) or an airlift system. It is anticipated that the airlift systems utilize gaseous carbon dioxide (i.e. Aqua Freed process). It is anticipated that the well may or may not be sealed under normal operation with a packer or some other type of well seal. If the well was sealed the airlift system could involve a permanently installed well liner (suction flow control device—SFCD) to work as the conduit for carrying or lifting water to the surface. This may be operated with alternating cycles of injection and air lifting. This would also involve valves above ground that could be operated manually or automatically to alternate between the cycles of injection and air lifting or pumping.

If the well was not equipped with a liner or suction flow control device then the well casing itself could be the conduit for evacuating water and other sediments from the well. This procedure would involve the injection of liquid and gaseous carbon dioxide to achieve detachment of the material from the surfaces in the well and aquifer. After the gaseous and liquid carbon dioxide was applied as per the Aqua Freed™ procedure, the pressure could be released from the well. Once the pressure was released and depending upon discharge regulations and requirements, the material could be air lifted from the well utilizing an air line terminating several feet above the bottom of the well casing inside the well. It is also anticipated that because of the limitations of getting the material (i.e. sediments) lifted from the bottom of the well that an additional line be used to keep the sediments agitated and fluidized. Once the sediments are fluidized in the bottom part of the well, there should be enough uphole velocity to keep the particles moving to the point where the air lift system or pump in the casing has the velocities and the energy to carry them out of the well. Research in sediment transport has found that it takes many times more energy to get a particle moving than it does to keep it moving. Therefore the challenge is often achieving the energy necessary to get a particle moving. This is the reason behind the concept of multiple injection lines at various levels with depth in the well. With multiple injection lines it is possible to maintain the energy, as gaseous carbon dioxide is moving upward in the column of water. This energy will then carry the sediments upward in the well until it is evacuated from the well.

The advantage of the permanently installed equipment is reduction of maintenance costs associated with keeping a well in the most efficient operating condition. In order to keep a well operating efficiently it is necessary to keep the surfaces clean. In order to keep the surfaces clean it is necessary to perform a cleaning process perhaps frequently. The concept of the patent would allow for more effective, less costly preventative maintenance treatments on the well.

Some of the advantages of keeping the surfaces clean include greater longevity of treatments and maintaining safe bacterial results. Greater longevity between treatments involves removal of material from the surfaces preferably to original surfaces. If the deposits are removed from the surfaces to original conditions then all of the excess pore volume exists in the porous media or aquifer. If the excess pore volume exists then as soon a deposition or plugging deposits exist it does not start to impact the specific capacity of the well. It is not until the well starts to experience turbulent flow losses that the specific capacity would begin to decline.

Another advantage of keeping the surfaces clean would involve maintaining safe bacterial samples. Many water samples are considered unsafe due to the presence of total coliforms or the presence of other bacteria. It is common for wells to experience these unsafe samples as they get older. The reason older wells experience these unsafe bacterial samples is often due to detachment of normally attached material. This detached material consists of biofilms and their associated minerals. The detachment of the biofilms is often the source of the unsafe bacterial results. Once enough material is built up on the surface it is common for the velocities to increase and detach the material. This detached material is often biofilm including the total coliforms. In order to prevent this material from detaching and resulting in unsafe bacterial results it is essential to keep the surfaces clean. In order to keep the surfaces clean it is necessary to utilize some or all of the above described procedures and processes.

It is also proposed that a series of lines be placed with depth in the well. In order to effectively remove material from the bottom part of the well as already described, It is proposed that part of the injection process would involve injecting at different parts of the well with depth and then moving to the next injection point above. In order to describe this process an example of three injection points could be used. The removal process would begin by injecting into the bottom most injection point and at the same moment of starting to inject in the next one up the injection is stopped in the bottom. After several moments of injecting in the second injection point the next one up is injected into while the middle injection point is stopped. The concept is as the carbon dioxide vapors are going up in the well column they are carrying sediments upward. In order to keep the sediments moving upward the injection can be used as described above. This process can be repeated until no more material is being removed indicating that the surfaces within the water environment are effectively clean.

There will be significant differences in configuration of the installed equipment or appurtenances. These differences result from differences in well construction and use. The concept of Cleaning In Place (CIP) with permanent equipment is unique.

The procedure and equipment for maintenance of wells can vary significantly depending upon well design, well problems, well construction, site considerations, and well operation. The procedure outlined here is only one of the many applications of the concept. The unique feature is equipping the well permanently with the equipment and appurtenances that allows material to be removed from the well more effectively without the need for expensive mobilization of equipment. The periodic cleaning of wells can be performed periodically and more effectively.

BRIEF DESCRIPTION OF THE DRAWINGS

As seen in FIGS. 3 and 4, under normal operation water can be injected into the well through installed pipe (10). During the injection mode the packer (1) can be either inflated creating a positive seal or it can be deflated. The well can be either sealed or unsealed during normal operation depending upon normal operation history of the well. If the well is normally sealed then the well can be operated under the normal sealed condition. If the well is operated unsealed then the first thing that needs to be done during the well maintenance service, is inflation of the packer (1) or sealing of the well. The packer can be inflated through inflation line (3) and the pressure on the packer can be monitored with pressure gauge (4). After the well is sealed then injection lines can be connection to injection lines (8, 11 and 12). Air, nitrogen, other inert gases or gaseous and/or liquid carbon dioxide and or chemicals can then be injected into the sealed well (17). The well can then be left in a sealed condition to allow the energy to dissolved and disrupt deposits. The energy of dissolution, energy of disruption and energy of detachment can be left in a sealed well for several hours. After the well is left sealed and energy allowed to work, the packer (1) can be deflated, water can be pumped from the well to begin the backflushing process. Water can be pumped from the well by injecting some gas such as gaseous carbon dioxide through line (7), which terminates inside the educator pipe (10). This educator pipe (10) is the same pipe that can be used for injection of water during normal operation and also can be used to pump water and the associated sediments from the well. This type of backflushing of wells is currently used occasionally to extend the time between more aggressive well rehabilitation treatments. This backflushing can be effective at removing some of the plugging deposits from the well, but is limited in achieving good removal of material from the well due to the limitations outlined in the above text. While the well is being pumped through eductor pipe (10) and discharged at surface, gaseous and or liquid carbon dioxide is injected into the well through injection line (5). The injection of a gas and or liquid carbon dioxide has the energy necessary to detach, fluidize and mobilize the sediments from the surfaces and allow them to be carried upward in the pumping well (17). The injection of gaseous and or liquid carbon dioxide through injection line (5) can be done for different periods of time depending upon evaluation of the sediments being discharged through eductor pipe (10). This period of injection could be from several seconds to minutes or even hours. After a period of injection through injection line (5), gaseous and or liquid carbon dioxide through injection lines (6). The injection time through injection line (6) can vary as described for injection line (5). There can be multiple injection lines placed in the well at various depths. Well depth, diameter, operation, etc determine the placement of these permanent injection lines (5, 6). There could be as many injection lines placed in the well as determined is necessary or determined by what will fit into the well. Flow logs on a well under dynamic conditions can determine the need for these injection lines at various depths. A flow log or production profile while a well is being pumped can determine if the lower zones of the well have inadequate velocity necessary to carry sediments upward in the pumping well. Even if the sediments can be adequately carried it will often be necessary to install the injection lines in the bottom part of the well to allow the placement of gaseous and or liquid carbon dioxide, in the zones of the well to achieve detachment of deposits from the surfaces. The injection of gaseous and liquid carbon dioxide through injection lines (5, and 6) can be performed in repeated cycles until no more sediment is being removed from the well, or until it is determined to stop. These cycles of injection can include injection through line (5) for several seconds. After several seconds the injection through line (5) can be terminated and the injection can be started through line (6) for several seconds. This can then be repeated for as many cycles as deemed necessary. These cycles will carry sediments upward as the gas bubbles rise in the well and also will fluidize the deposits allowing them to be mobilized towards the pump intake (Airlift or other type of pump).

Under normal operation valve (20) is kept in a closed position. Water is injected into the well through valve (21), which is kept in a normally open position to inject water into the well through eductor pipe (10).

When the well is scheduled for a maintenance treatment, valve (21) is closed and water is prevented from entering the well. The backflushing procedure and well maintenance procedure is initiated. The first step involves opening valve (20) and start air or gas flow into the well through line (7). The airlift system will then pump water from the well through the eductor pipe and valve (20). This valve needs to be connected to a proper disposal or containment of the discharge water. Once this is initiated the procedure for the rest of the well maintenance as previously described.

Figure 1:
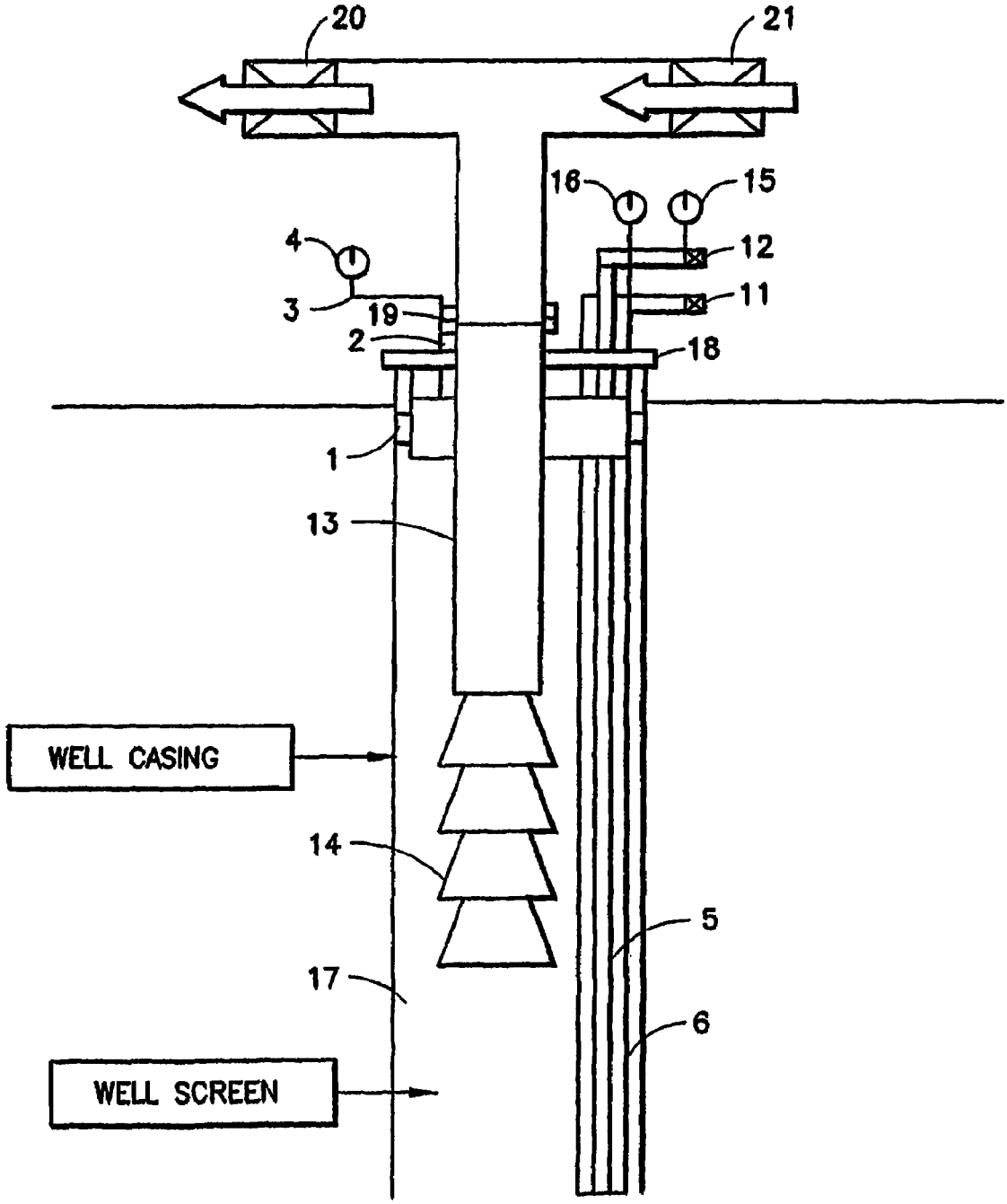
FIG. 1 is an injection or ASR well installed with a pump in place and equipped with well maintenance.
Figure 2:
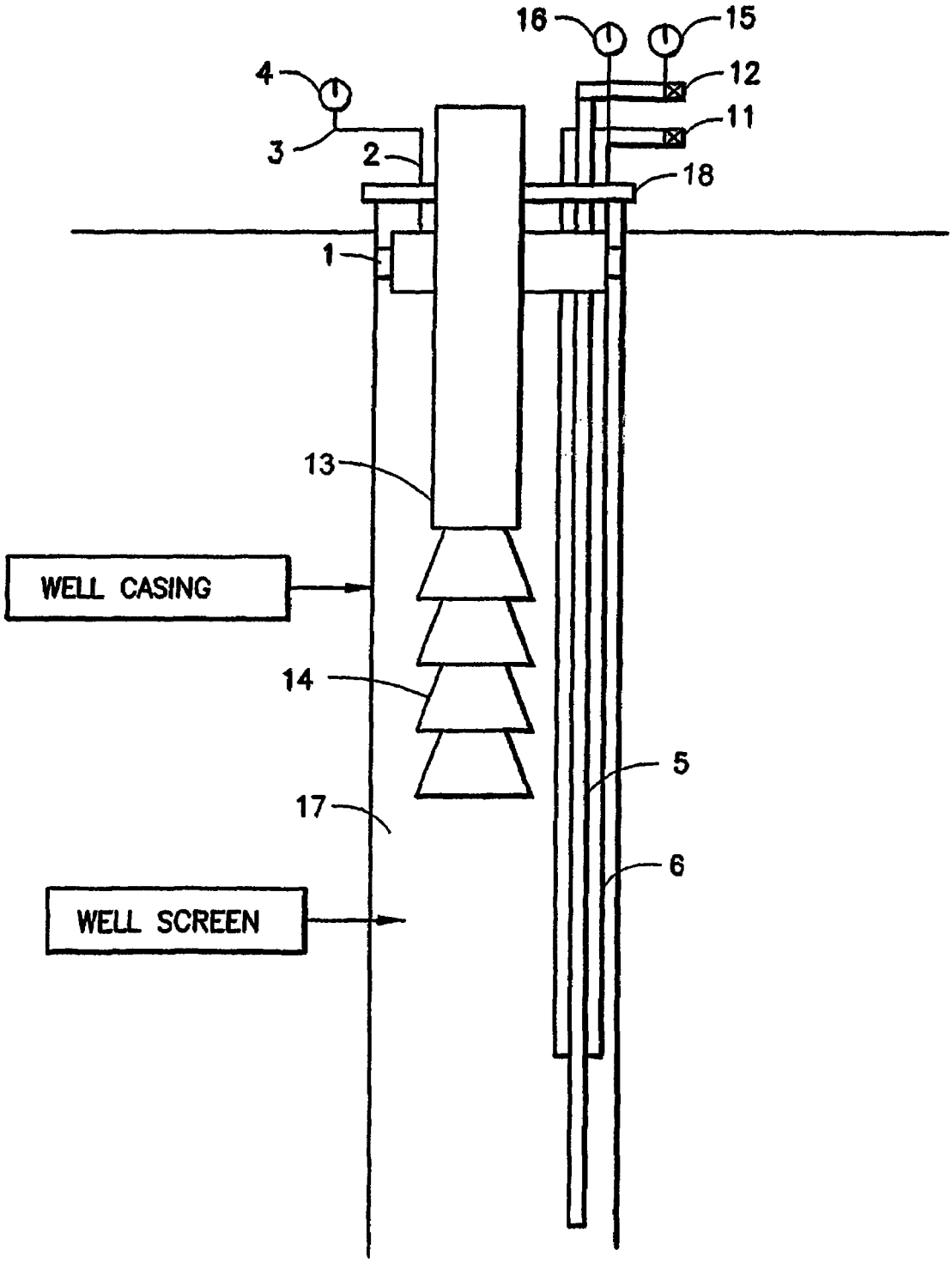
FIG. 2 is a well maintenance device installed on a water well (any type of water well) with a pump installed.
Figure 3:
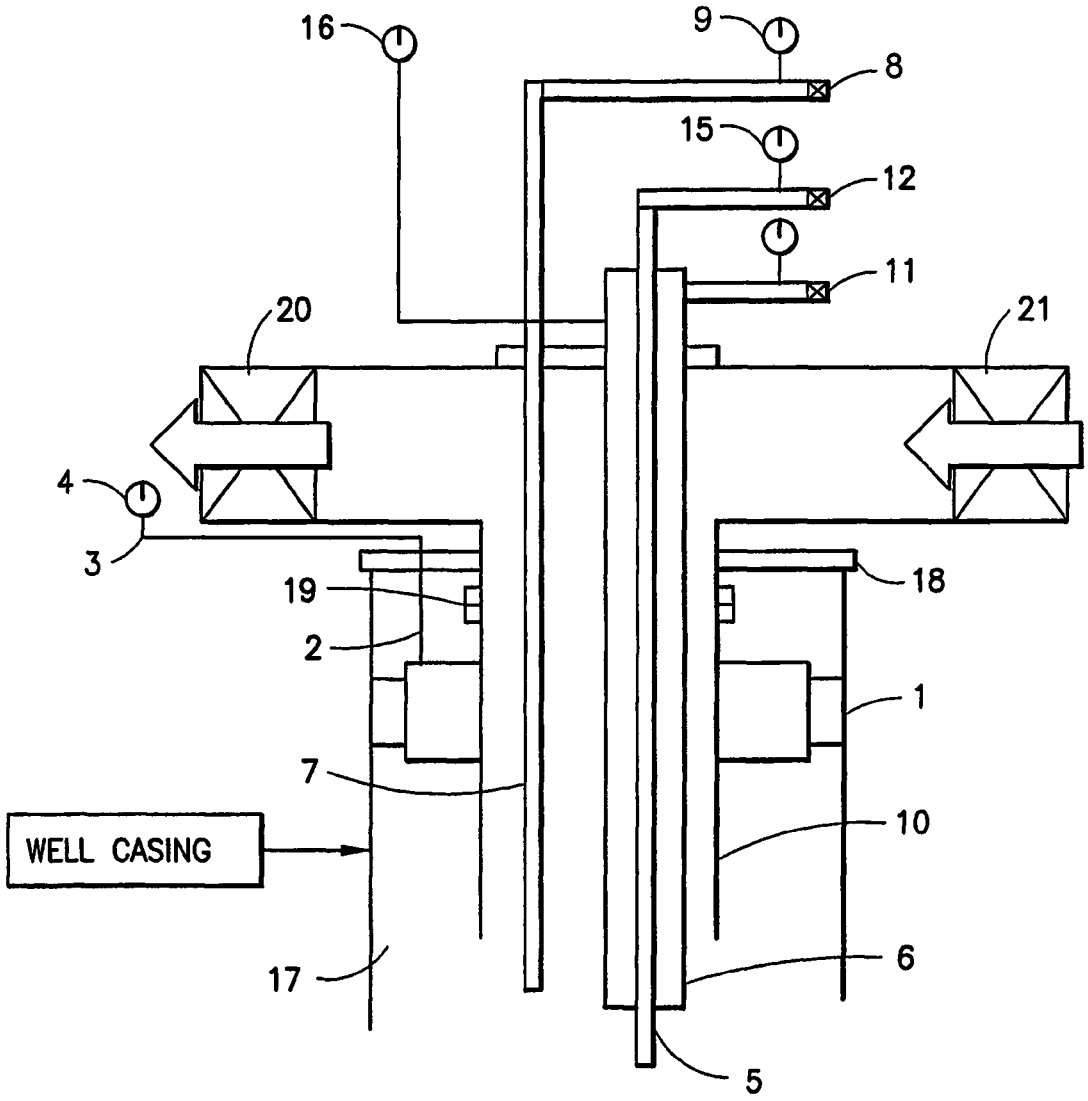
FIG. 3 is a well head detail for an injection well and ASR well.
Figure 4:
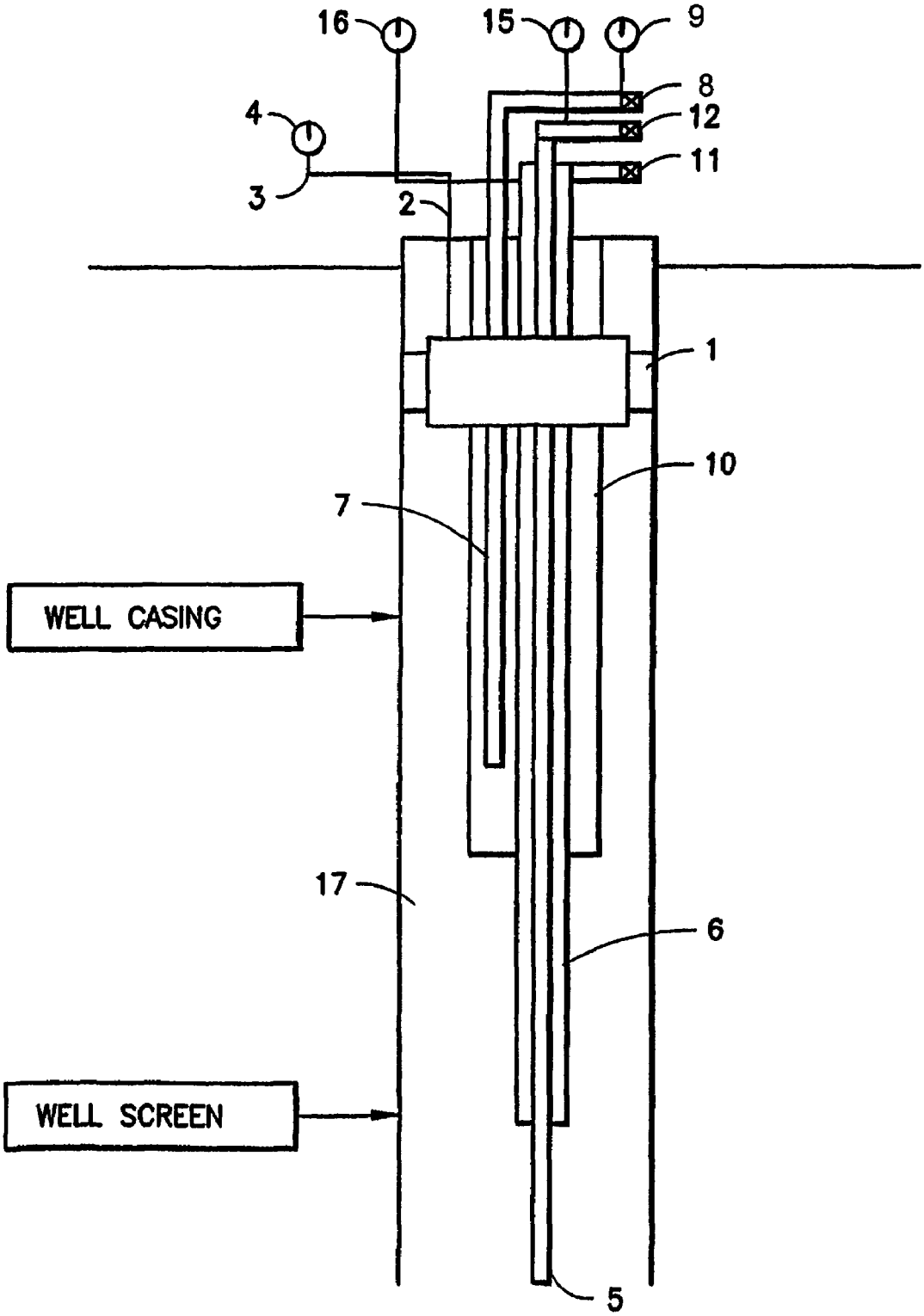
FIG. 4 is a well that is not equipped with a pump and well maintenance incorporates an airlift pump installed.

As seen in FIGS. 1 and 2, under normal operation water can be injected into the well for storage and later for recovery through installed column pipe (13) and pump (14). During the injection mode the packer (1) can be either inflated creating a positive seal or it can be deflated. The well can be either sealed or unsealed during normal operation depending upon normal operating history of the well. If the well is normally sealed then the well can be operated under the normally sealed condition. If the well is operated unsealed then the first thing that needs to be done during the well maintenance service, is inflation of the packer (1) or sealing of the well. The packer can be inflated through inflation line (3) and the pressure on the packer can be monitored with pressure gauge (4). After the well is sealed then injection lines can be connected to injection lines (11, and 12). Air, nitrogen, other inert gases or chemical and/or gaseous and/or liquid carbon dioxide can then be injected into the sealed well (17).

The well can then be left in a sealed condition to allow the energy to dissolved and disrupt deposits. The energy of dissolution, energy of disruption and energy of detachment can be left in a sealed well for several hours.

After the well is left sealed and energy allowed to work, the packer (1) can be deflated, water can be pumped from the well by turning on the pump to begin the backflushing process. The column pipe (13) is the same pipe that can be used for injection of water during normal operation and also can be used to pump water and the associated sediments from the well. This type of backflushing of wells is currently used occasionally to extend the time between more aggressive well rehabilitation treatments. This backflushing can be effective at removing some of the plugging deposits from the well, but is limited in achieving good removal of material from the well due to the limitations outlined in the above text. While the well is being pumped through column pipe (13) and discharged at surface, gaseous and or liquid carbon dioxide is injected into the well through injection line (5). The injection of a gas and or liquid carbon dioxide has the energy necessary to detach, fluidize and mobilize the sediments from the surfaces and allow them to be carried upward in the pumping well (17) and toward the pump intake. The injection of gaseous and or liquid carbon dioxide through injection line (5) can be done for different periods of time depending upon evaluation of the sediments being discharged through eductor pipe (10). This period of injection could be from several seconds to minutes or even hours. After a period of injection through injection line (5), gaseous and or liquid carbon dioxide through injection lines (6). The injection time through injection line (6) can vary as described for injection line (5). There can be multiple injection lines placed in the well at various depths. Well depth, diameter, operation, etc determine the placement of these permanent injection lines (5, 6). There could be as many injection lines placed in the well as determined is necessary or determined by what will fit into the well. Flow logs on a well under dynamic conditions can determine the need for these injection lines at various depths. A flow log or production profile while a well is being pumped can determine if the lower zones of the well have inadequate velocity necessary to carry sediments upward in the pumping well. Even if the sediments can be adequately carried it will often be necessary to install the injection lines in the bottom part of the well to allow the placement of gaseous and or liquid carbon dioxide, in the zones of the well to achieve detachment of deposits from the surfaces. The injection of gaseous and liquid carbon dioxide through injection lines (5, and 6) can be performed in repeated cycles until no more sediment is being removed from the well, or until it is determined to stop. These cycles of injection can include injection through line (5) for several seconds. After several seconds the injection through line (5) can be terminated and the injection can be started through line (6) for several seconds. This can then be repeated for as many cycles as deemed necessary. These cycles will carry sediments upward as the gas bubbles rise in the well and also will fluidize the deposits allowing them to be mobilized towards the pump intake.

Under normal operation valve (20) is kept in a closed position. Water is injected into the well through valve (21), which is kept in a normally open position to inject water into the well through column pipe (13).

When the well is scheduled for a maintenance treatment, valve (21) is closed and water is prevented from entering the well. The backflushing procedure and well maintenance procedure is initiated. The first step involves opening valve (20) and start pumping the well through column pipe (13) and properly discharged out of valve (20). The pump will then pump sediment from the well through the column pipe and valve (20). This valve needs to be connected to a proper disposal or containment of the discharge water. Once this is initiated the procedure for the rest of the well maintenance as previously described.

The well can be permanently sealed with a flanged well head and plate (18). The modified wellhead assembly can also be attached to flanged column pipe at flange (19) allowing for easy removal if some other type of wellhead assembly needs to be connected.

This outlines only one configuration and is not meant to encompass all the possibilities of different possible configurations. There are expected to be many different types of equipment for well maintenance necessary to achieve less expensive and easier cleaning of the well on a periodic basis. The diagrams also demonstrate a well with a well screen. It is also expected to install well maintenance equipment into wells that do not have a well screen and are completed as open hole rock wells. These consolidated formations can occur in many different geologic settings.

The placement of energy, injection equipment is also anticipated to be installed into horizontal wells.

The invention claimed is:

1. In a method for removing deposits from a water well comprising an aquifer storage and recovery well, a water supply well, a barrier well, an injection well, a recharge well or a disposal well, horizontal well, or environmental recovery well and surrounding aquifer, the method comprising:

a) providing said water well with a means for delivering energy to the water well for removing deposits, wherein said energy delivering means comprises mechanical energy, and wherein said energy delivering means provides for injection of gaseous and/or liquid carbon dioxide directly into said water well, and wherein said energy delivering means is permanently attached to said water well and fixed in place in said water well and capable of being activated when deposit removal is required, said energy is activated when deposit removal is desired with a permanent pumping equipment installed in said water well;

b) optionally using said energy delivery means to backflush in said water well, c) activating said means for delivering energy when deposit removal is required;

d) providing energy to the well through said energy delivering means by delivering liquid carbon dioxide or a mixture of gaseous and liquid carbon dioxide to remove deposits from the well;

e) allowing said liquid carbon dioxide or mixture of gaseous and liquid carbon dioxide to act to dissolve, detach, mobilize, and/or fluidize said deposits over a period of time in said well;

f) inactivating said means and allowing the means to remain connected to the well until activation is required for deposit removal.

2. The method of claim 1, further comprising delivering chemical energy to said well to remove material from said well or surrounding aquifer.

3. The method of claim 1, wherein the removing of deposits from said well is automated.

4. The method of claim 1, wherein said water well is sealed when said energy delivering means is activated.

* * * * *